US005242724A

United States Patent [19]

You

[11] Patent Number: 5,242,724

[45] Date of Patent: Sep. 7, 1993

[54] SHOCK-ABSORBING RACKET FRAME MADE FROM FIBER REINFORCED PLASTIC MATERIAL

[76] Inventor: Chin-San You, No. 3 Lane 1029, Feng-Shyn Rd, Feng Yuan City, Taichung Hsien, Taiwan

[21] Appl. No.: 806,185

[22] Filed: Dec. 13, 1991

[51] Int. Cl.[5] ..... B32B 31/04; A63B 49/10

[52] U.S. Cl. ..... 428/36.4; 273/73 R; 273/73 G; 273/73 J; 273/73 F

[58] Field of Search ..... 428/36.9, 376, 377, 428/36.4; 273/73 R, 73 G, 73 J, 73 F

[56] References Cited

U.S. PATENT DOCUMENTS

| | | | |
|---|---|---|---|
| 4,177,990 | 12/1979 | Kajiwara | 273/73 F |
| 4,203,596 | 5/1980 | Nagamoto | 273/73 F |
| 5,034,082 | 7/1991 | Nolan | 273/73 F |
| 5,039,096 | 8/1991 | Chen | 273/735 |
| 5,071,125 | 12/1991 | Shen | 273/73 R |
| 5,092,594 | 3/1992 | Jang | 273/73 R |

FOREIGN PATENT DOCUMENTS

| | | | |
|---|---|---|---|
| 2495477 | 6/1982 | France | 273/73 F |

*Primary Examiner*—George F. Lesmes
*Assistant Examiner*—Charles R. Nold
*Attorney, Agent, or Firm*—Browdy and Neimark

[57] ABSTRACT

A shock-absorbing racket frame made of fiber reinforced plastic material is mainly composed of a head frame and a shaft-handle portion. The racket frame is further provided with a thin plastic tube wrapped around by a first outer layer made of fiber reinforced plastic material and intended to form the head frame and the front segment of the shaft-handle portion. The thin plastic tube is further wrapped around by a second outer layer of fiber reinforced plastic material intended to form the hand grip of the shaft-handle portion. A reinforced surface of fiber reinforced plastic material is disposed across the gap between the two outer layers. The fibers making up the head frame are thus interrupted and disconnected with the fibers making up the hand grip of shaft-handle portion. The transmission of the shock wave from the head frame is therefore effectively interrupted at the position where the break of fibers takes place, thereby resulting in the shock wave being mitigated to an extent that the player's hand holding the racket is not subjected to injury.

10 Claims, 4 Drawing Sheets

SHOCK-ABSORBING RACKET FRAME MADE FROM FIBER REINFORCED PLASTIC MATERIAL

BACKGROUND OF THE INVENTION

The present invention relates to a racket frame, and more particularly to a racket frame which is made from fiber reinforced plastic material and is capable of absorbing most of shock before the shock wave reaches the handle portion of the racket.

According to the conventional manufacturing method of a racket made from fiber reinforced plastic material, the racket frame is made from a plurality of carbonaceous fiber or glass fiber fabric sheets which are preimpregnated with thermosetting resin and are intertwined to form a long tubular object. Such tubular object is then placed in a mold cavity having a shape of racket to be treated and then subjected to heat and pressure so as to take shape to form a prototype racket. As a result, the racket frame so made is composed of multiple layers of fiber extending continuously from the head frame to the handle without interruption. It is therefore apparent that a player using such racket is subjected to hand injury brought about by the shock which is transmitted easily to the handle portion from the head frame upon hitting a ball.

In order to mitigate such incidence of hand injury described above, a new racket having a shock-absorbing handle was introduced, as exemplified in SHOCK-ABSORBING HANDLE OF RACKET in the Taiwan Patent Number 7/8,201,997 in which the handle provided with a one-way opening is fitted to the shaft of the racket in such ways that a shock-absorbing elastic body is embedded therebetween and that the bottom portion of the handle is coupled with a spring. Such shock-absorbing handle of racket is defective in that its structures are too complicated to be manufactured easily and in that its shock-absorbing effect is poor in view of the fact that it is designed to dampen the shock only after the shock wave has been transmitted to the handle. Another category of prior art structures is disclosed by Chen in the Taiwan Patent Number 7/8,210,299, in which the handle of the racket made from fiber reinforced plastic material is provided with a plurality of grooves which are respectively filled with shock-absorbing girdles. Such racket handle also has a limited shock-absorbing capability, because fibers making up the racket extend continuously from the head frame to the handle without interruption, thereby permitting the shock wave to be transmitted easily to the handle from the head frame where the shock is originated.

SUMMARY OF THE INVENTION

It is therefore the primary objective of the present invention to provide a racket frame which is made from fiber reinforced plastic material and is capable of absorbing effectively the shock wave transmitted to the handle from the head frame upon hitting a ball.

It is another objective of the present invention to provide a racket frame which is made from fiber reinforced plastic material and is provided with appropriate strength and elasticity in the shaft thereof.

In keeping with the principles of the present invention, the objectives of the present invention are accomplished by a racket frame comprising a head frame and a shaft-handle portion. The present invention is characterized in that the racket frame is composed of a thin plastic tube, which is in turn encased by the first outer layer made from fiber reinforced plastic material to form the head frame and the front segment of the shaft-handle portion. The thin plastic tube is additionally encased by the second outer layer made from fiber reinforced plastic material to form the rear segment of the shaft-handle portion. These first and second outer layers are formed adjacent one another with at least a discontinuity therebetween, which discontinuity may constitute a gap. Furthermore, a reinforced surface of predetermined width made from fiber reinforced plastic material is disposed across the discontinuity or gap between the first and the second outer layers. As a result, the fibers making up the head frame are interrupted and disconnected with the fibers making up the hand grip or the rear segment of the shaft-handle portion. Therefore, the transmission of shock wave from the head frame is effectively interrupted at the position where the break of fibers takes place, thereby resulting in the shock wave being mitigated to an extent that the player's hand holding the racket is not subjected to injury. In addition, the point of shaft-handle portion, where the break of fibers occurs, is protected and reinforced by a reinforced surface of predetermined width so that the structural strength and elasticity of the shaft-handle are not undermined.

The shock-absorbing racket frame made from fiber reinforced plastic material and embodied in the present invention is further characterized in that the neighboring ends of its first and the second outer layers are provided respectively with the connection portions comprising a plurality of overlapped strip-like structures so as to eliminate the concentration of stress between the first and the second outer layers.

The shock-absorbing racket frame made from fiber reinforced plastic material and embodied in the present invention is still further characterized in that it is provided with a predetermined gap located between the first and the second outer layers and in that it is composed of a plurality of reinforced strips, which are made from fiber reinforced plastic material and are disposed in such manners that they are parallel to the axial center of the shaft-handle portion, and that they cross over the gap between the first and the second outer layers, and further that they are attached securely at both ends thereof to the neighboring ends of the first and the second outer layers. As a result, the racket frame of the present invention is capable of absorbing shock effectively and of providing with appropriate rigidity and elasticity.

The shock-absorbing racket frame made from fiber reinforced plastic material and embodied in the present invention is still further characterized in that it is provided with at least a shock-absorbing elastic layer disposed at the point where the first and the second outer layer meet.

The foregoing objectives, functions, and features of the present invention will be better understood by studying the following detailed description of the preferred embodiments in conjunction with the drawings provided herewith.

DETAILED DESCRIPTION OF THE PREFERRED EMBODIMENTS

Figure 1:
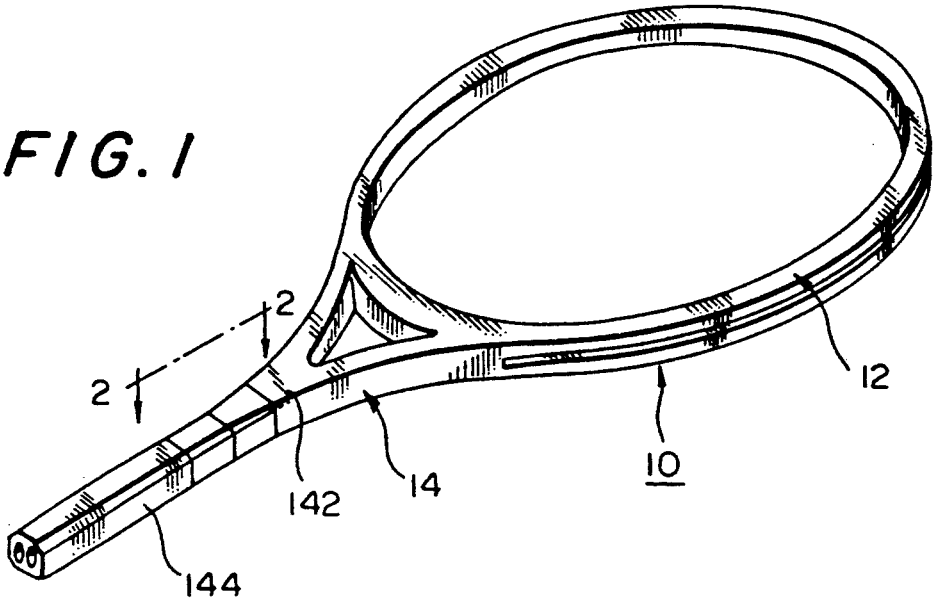
FIG. 1 shows a three-dimensional view of the first preferred embodiment of the present invention.
Figure 2:
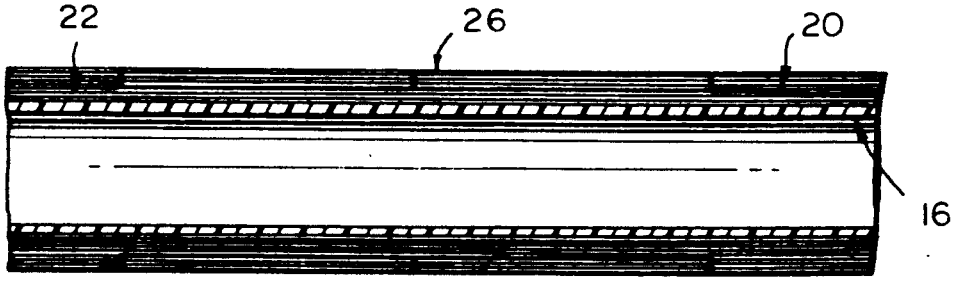
FIG. 2 shows a sectional view of the portion taken along the line 2—2 as shown in FIG. 1.
Figure 3:
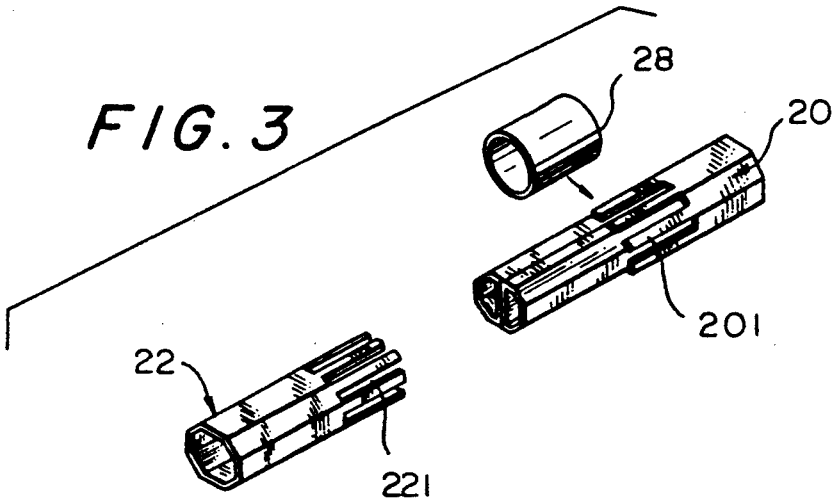
FIG. 3 shows an exploded view of portions of the second preferred embodiment of the present invention.
Figure 4:
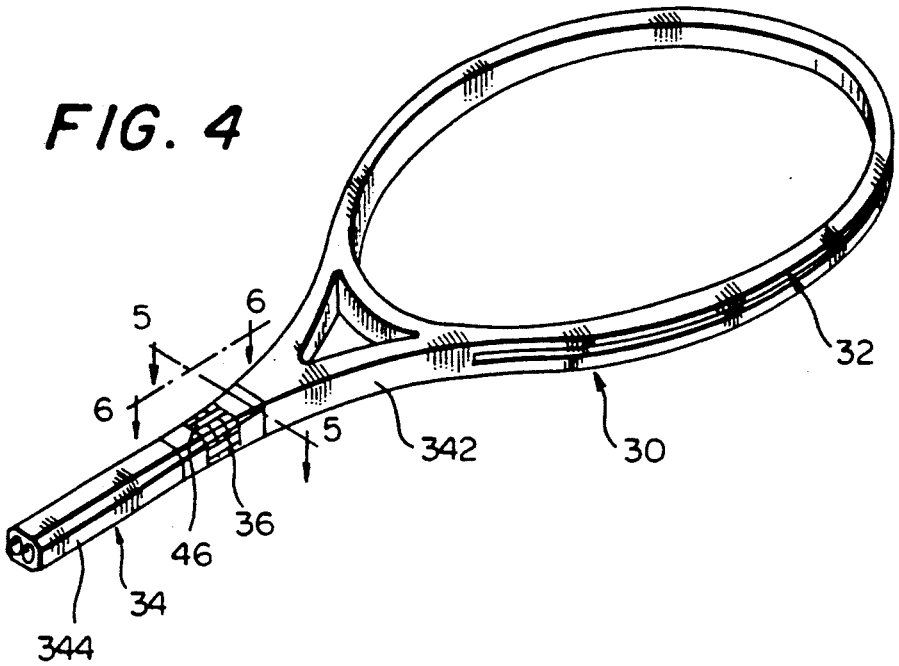
FIG. 4 shows a three-dimensional view of the third preferred embodiment of the present invention.
Figure 5:
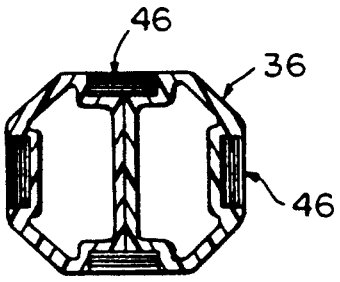
FIG. 5 shows a sectional view of the portion taken along the line 5—5 as shown in FIG. 4.

Referring to FIGS. 1, 2, and 3, the racket frame 10 of the first and the second preferred embodiments of the present invention is shown comprising a head frame 12 and a shaft-handle portion 14 extending axially from the open end of the head frame 12.

The racket frame 10 is additionally provided with a thin hollow plastic tube 16 wrapped around with the first outer layer 20 made from fiber reinforced plastic material and intended to make up the head frame 12 and the front segment 142 of the shaft-handle portion 14. The racket frame 10 is further provided with a second outer layer 22 wrapping around the thin plastic tube 16 for forming the rear segment 144 of the shaft-handle portion 14, and with a reinforced surface 26 which is made from fiber reinforced plastic material and is disposed across the gap or discontinuity between the first outer layer 20 and the second outer layer 22 in such a manner that its ends are respectively adhered to the neighboring ends of the first and the second outer layers 20 and 22. In the process of manufacturing the racket frame 10, a plurality of fiber fabric sheets preimpregnated with thermosetting resin are wound around the thin plastic tube 16 to form the first and the second outer layers 20 and 22, while the reinforced surface 26 is formed by the rewinding of the fiber fabric over the gap between the first and the second outer layers 20 and 22. The tubular body containing the thin plastic tube 16 wrapped around with fiber fabrics as described above is then placed in a molding cavity, in which it is treated under heat and pressure to take form of a racket frame 10 of the present invention.

In addition, the neighboring ends of the first and the second outer layers 20 and 22 of the racket frame 10 are provided respectively with connection portions 201 and 221 comprising a plurality of overlapped strip-like or extending tongue structures which may interengage with one another. The connection portions 201 and 221 are respectively covered with elastic shock-absorbing bodies 28 and are subsequently encased by the reinforced surface 26, as shown in FIG. 3.

It is apparent that fibers making up the first and the second outer layers 20 and 22 of the racket frame 10 are interrupted so that most of the shock wave transmitting from the head frame 12 toward the shaft-handle portion 14 is effectively dampened at the gap between the first and the second outer layers 20 and 22. As a result, the residual shock wave reaching the hand grip or the rear segment 144 of the shaft-handle portion 14 is so weak that the hand grip of the player holding the racket frame 10 is not vulnerable to injury.

Now referring to FIGS. 4, 5, 6, and 7, the racket frame 30 of the third preferred embodiment of the present invention is shown comprising a head frame 32 and a shaft-handle portion 34.

Figure 6:
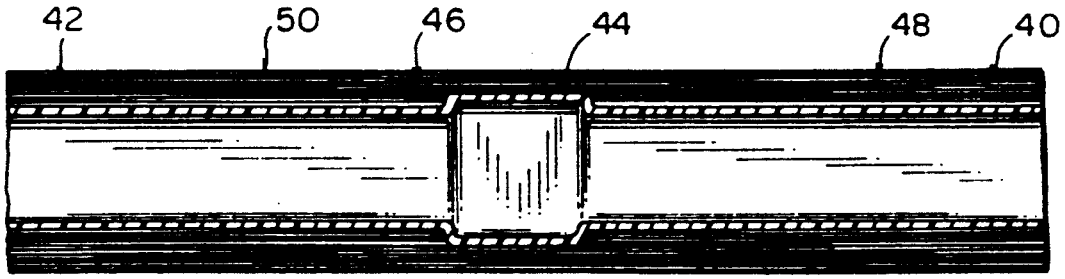
FIG. 6 shows a sectional view of the portion taken along the line 6—6 as show in FIG. 4.
Figure 7:
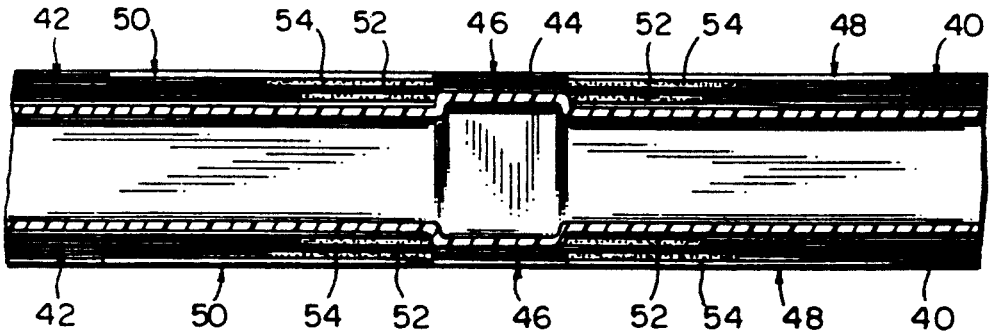
FIG. 7 shows a longitudinal sectional view of the fourth preferred embodiment of the present invention.

The racket frame 30 is additionally provided with a thin plastic tube 36, the first outer layer 40 made from fiber reinforced plastic material and intended to form the head frame 32 and the front segment 342 of the shaft-handle portion 34, and the second outer layer 42 made from fiber reinforced plastic material and intended to form the rear segment 344 of the shaft-handle portion 34. In addition, there are provided a gap 44 formed between the first and the second outer layers 40 and 42 and four reinforced strips 46 made from fiber reinforced plastic material and arranged in such manners that they are spaced apart at intervals of 90 degrees and so that they cross over the gap 44 so as to adhere at both ends thereof to the neighboring ends of the first and the second outer layers 40 and 42. Furthermore, there are provided a first reinforced surface 48 and a second reinforced surface 50, as shown in FIGS. 6 and 7. The first reinforced surface 48 crosses over one end of the reinforced strip 46 and the first outer layer 40, while the second reinforced surface 50 crosses over the other end of the reinforced strip 46 and the second outer layer 42. As a result, shock-absorbing effect of the racket frame 30 is efficaciously achieved. In the meantime, the racket frame 30 is provided with appropriate structural strength and resilience. In order to enhance the shock-absorbing capability of the racket frame 30, elastic shock-absorbing pieces 52 and 54 made from soft plastic material are embedded in the places located respectively between the reinforced strip 46 and the connection face formed by first and second outer layers 40 and 42, and between the reinforced strip 46 and the connection face formed by first and second reinforced surfaces 48 and 50, as shown in FIG. 7.

Figure 8:
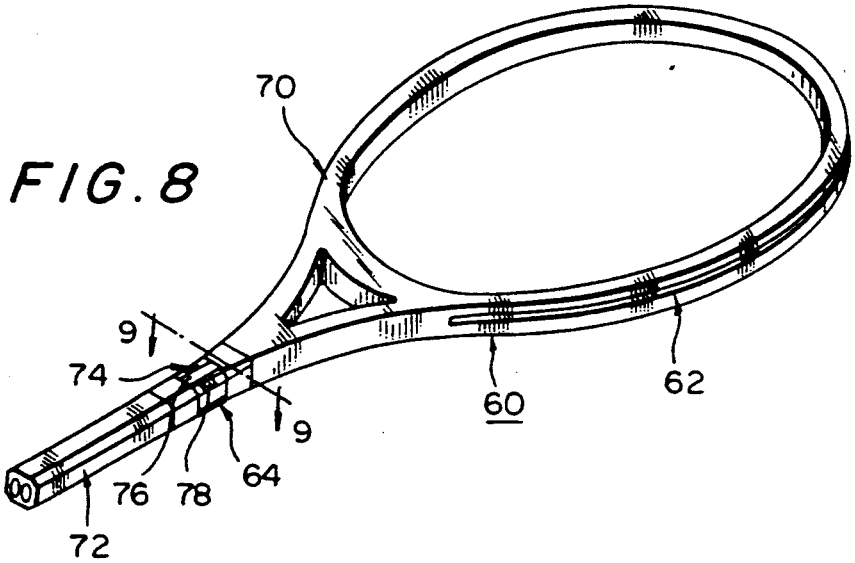
FIG. 8 shows a three-dimensional view of the fifth preferred embodiment of the present invention.
Figure 9:
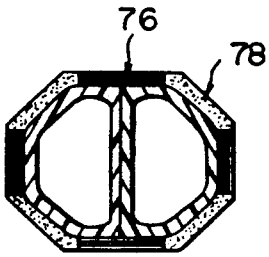
FIG. 9 shows a sectional view of the portion taken along the line 9—9 as shown in FIG. 8.
Figure 10:
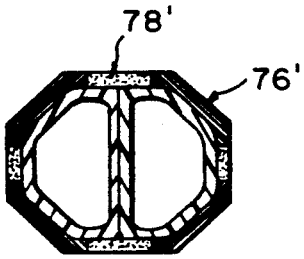
FIG. 10 shows a cross-sectional view of the sixth preferred embodiment of the present invention.
Figure 11:
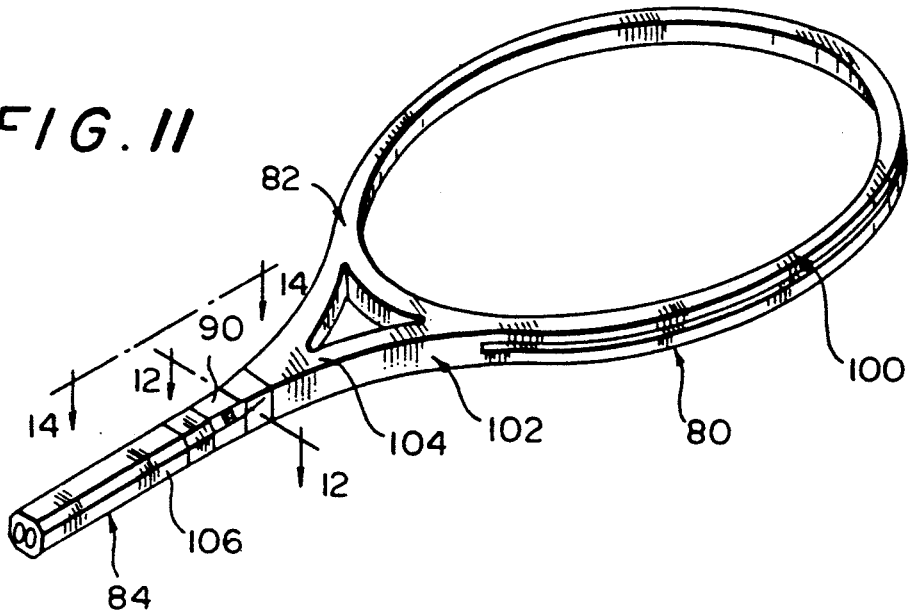
FIG. 11 shows a three-dimensional view of the seventh preferred embodiment of the present invention.
Figure 12:
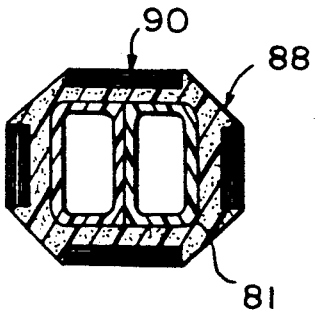
FIG. 12 shows a sectional view of the portion taken along the line 12—12 as shown in FIG. 11.
Figure 13:
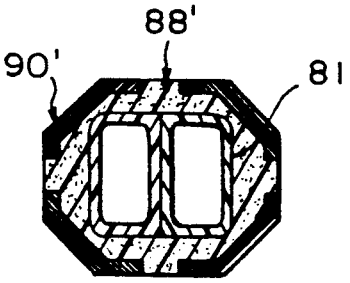
FIG. 13 shows a cross-sectional view of the eighth preferred embodiment of the present invention.
Figure 14:
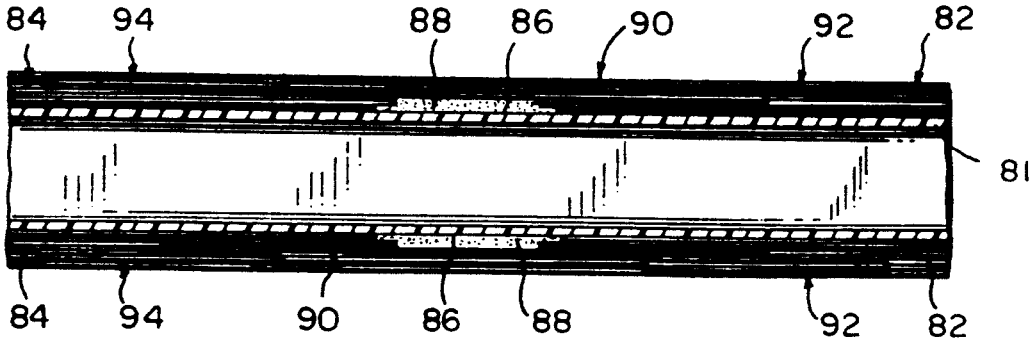
FIG. 14 shows a sectional view of the portion taken along the line 14—14 as shown in FIG. 11.

Referring to FIGS. 8, 9, and 10, the racket frame 60 of the fifth and the sixth preferred embodiments of the present invention is shown comprising a head frame 62 and a shaft-handle portion 64.

The structural arrangement of the racket frame 60 is similar to that of the previous racket frame, with the only difference being that it comprises elastic shock-absorbing pieces 78 which are made of soft elastic plastic material and are disposed between the two reinforced strips 76 arranged in the gap 74 formed by the first and the second outer layers 70 and 72. As a result, the racket frame 60 is provided with better shock-absorbing capability. The arrangement of reinforced strips 76 and elastic shock-absorbing pieces 78 can be done in accordance with the patterns shown respectively in FIGS. 9 and 10.

As shown in FIGS. 11, 12, 13, and 14, the racket frame 80 of the seventh and the eighth preferred embodiments of the present invention comprises mainly a thin plastic tube 81, the first outer layer 82 of fiber reinforced plastic material, and the second outer layer 84 of fiber reinforced plastic material. In addition, the racket frame 80 is provided with elastic shock-absorbing layers 88, which are made of soft plastic material and are disposed in the gaps 86 formed by the first and the second outer layers 82 and 84. Four reinforced strips 90 of fiber reinforced plastic material are disposed in such manners that they are spaced at 90-degree intervals and that they cross over the gaps 86 so as to permit their ends to be adhered respectively to the neighboring ends of the first and the second outer layers 82 and 84. The racket frame 80 is further provided with a first reinforced layer 92 and a second reinforced layer 94, both of which are made of fiber reinforced plastic material. The first reinforced layer 92 crosses over and wraps around one end of the reinforced strip 90 and the first outer layer 82, while the second reinforced layer 94 crosses over and wraps around one end of the reinforced strip 90 and the second outer layer 84.

The first outer layer 82 forms the head frame 100 and the front segment 104 of shaft-handle portion 102, while the second outer layer 84 forms the rear segment 106 of shaft-handle portion 102. The first and the second outer layers 82 and 84 are not in direct contact and are spaced apart. In addition, an elastic shock-absorbing layer 88 is disposed in the gap 86 located between the two outer layers 82 and 84. Therefore gap 86 serves effectively to obstruct the transmission of shock wave from the head frame 100 to the hand grip or the rear segment 106 of shaft-handle portion 102. Furthermore, the structural strength and elasticity of the racket frame 80 are enhanced by means of reinforced strips 90 of predetermined width, length, and fiber orientation, which are disposed in such a way that they cross over the gaps 86. The first reinforced layer 92 and the second reinforced layer 94 also serve to enhance the rigidity and elasticity of the racket frame 80 by giving the reinforced strip 90 an added strength in construction.

The embodiments of the present invention described above are to be considered in all respects as merely illustrations of principles of the present invention. Accordingly, the present invention is to be limited only by the scope of the hereinafter appended claims.

What I claim is:

1. A shock-absorbing racket frame made from fiber reinforced plastic material comprising a head frame and a shaft-handle portion having a front segment and a rear segment and extending axially from one end of said head frame, said racket frame comprising a thin hollow plastic tube wrapped around with first outer layer of fiber reinforced plastic material along a first length thereof and second outer layer of fiber reinforced plastic material along a second length thereof with a discontinuity between said first and second outer layers, said first outer layer forming said head frame and said front segment of said shaft-handle portion and said second outer layer forming said rear segment of said shaft-handle portion, said first outer layer and said second outer layer and the discontinuity therebetween being crossed over by a reinforced surface of predetermined width in such a manner that said reinforced surface is adhered to neighboring ends of said first outer layer and said second outer layer.

2. A shock-absorbing racket frame made from fiber reinforced plastic material of claim 1, further comprising a first elastic shock-absorbing layer disposed between said reinforced surface and said first outer layer or said second outer layer.

3. A shock-absorbing racket frame made from fiber reinforced plastic material according to claim 1 or claim 2, wherein said first outer layer and said second outer layer are provided with connection portions, which are located at neighboring ends of said first outer layer and said second outer layer and are composed of a plurality of strip-like bodies.

4. A shock-absorbing racket frame made from fiber reinforced plastic material according to claim 3, wherein said connection portions are overlap each other.

5. A shock-absorbing racket frame made from fiber reinforced plastic material according to claim 1, wherein said first outer layer and said second outer layer are spaced apart so that the discontinuity therebetween forms a gap, and wherein the gap comprises therein reinforced strips of fiber reinforced plastic material, said reinforced strips being arranged in such manners that they are parallel to axial center of said shaft-handle portion and that they cross over said gap to adhere to said first outer layer and said second outer layer, said first outer layer and one end of said reinforced strip being crossed over and wrapped around by first reinforced surface, while said second outer layer and other end of said reinforced strip being crossed over and wrapped around by second reinforced surface.

6. A shock-absorbing racket frame made from fiber reinforced plastic material according to claim 5, wherein the gap formed by said reinforced strips is embedded with an elastic shock-absorbing piece of predetermined length.

7. A shock-absorbing racket frame made from fiber reinforced plastic material according to claim 5, wherein said gap located between said first outer layer and said second outer layer is provided with an elastic shock-absorbing layer.

8. A shock-absorbing racket frame made from fiber reinforced plastic material according to claim 5, or claim 6, or claim 7, wherein at least one of said outer layers and at least one of said reinforced strips form connection face provided therebetween with a second elastic shock-absorbing layer.

9. A shock-absorbing racket frame made from fiber reinforced plastic material according to claim 5, or claim 6, or claim 7, wherein at least one of said reinforced strips and at least one of said reinforced surfaces form connection face provided therebetween with a third elastic shock-absorbing layer.

10. A shock-absorbing racket frame made from fiber reinforced plastic material according to claim 6, wherein said elastic shock-absorbing piece crosses over the gap located between said first and second outer layers in such a manner that its ends are respectively adhered to the neighboring ends of said first and second outer layers.

* * * * *